US005593074A

United States Patent [19]

Matthews

[11] Patent Number: 5,593,074

[45] Date of Patent: Jan. 14, 1997

[54] BIDIRECTIONAL HOLSTERS

[75] Inventor: John W. Matthews, Corona del Mar, Calif.

[73] Assignee: Laser Products Ltd., Fountain Valley, Calif.

[21] Appl. No.: 451,483

[22] Filed: May 26, 1995

[51] Int. Cl.[6] ..... A45F 5/00

[52] U.S. Cl. ..... 224/251; 224/242; 224/245; 224/195; 224/904; 362/191; 362/396; D3/229

[58] Field of Search ..... 224/181, 222, 224/224, 197, 200, 151, 246, 242, 245, 250, 251, 252, 255, 195, 901, 904, 920, 926, 267; 362/190, 191, 103, 396; D3/229; 206/316.1, 316.2, 316.3

[56] References Cited

U.S. PATENT DOCUMENTS

| | | | |
|---|---|---|---|
| 3,589,574 | 6/1971 | Marburger | 224/253 |
| 4,055,015 | 10/1977 | Musgrave | 224/911 |
| 4,662,552 | 5/1987 | Uyehara | 224/251 |
| 5,161,721 | 11/1992 | Nichols | 224/911 |
| 5,358,110 | 10/1994 | Simpson | 206/316.2 |
| 5,440,465 | 8/1995 | Hasness | 362/191 |
| 5,449,104 | 9/1995 | Parsons et al. | 224/252 |

*Primary Examiner*—Henry J. Recla
*Assistant Examiner*—Timothy L. Maust
*Attorney, Agent, or Firm*—Benoit Law Corporation

[57] ABSTRACT

A holster for a flash light having a barrel and having a lamp housing wider than that barrel comprises a sheath for part of the flashlight having a first bore adapted to receive the lamp housing, and having a narrower second bore adapted to receive the barrel. Holster and flashlight combinations may use that holster. In one such combination, the flashlight has its barrel extending through the first and second bores of the sheath of the holster, and has its lamp housing projecting from such barrel above the first bore of that sheath. In another combination, the flashlight has its lamp housing in the first bore of the sheath, and has its barrel projecting from the lamp housing above the holster.

26 Claims, 2 Drawing Sheets

BIDIRECTIONAL HOLSTERS

FIELD OF THE INVENTION

This subject invention relates to holsters, including holsters for flashlights, and flashlight-holster combinations.

SUMMARY OF THE INVENTION

The invention resides in a holster for a flashlight having a barrel and having a lamp housing wider than said barrel, comprising a sheath for part of the flashlight having a first bore adapted to receive the lamp housing, having a narrower second bore adapted to receive the barrel and an internal channel adapted to accommodate a lateral projection of the flashlight.

The invention also resides in a holster and flashlight combination in which the flashlight has its barrel extending through the first and second bores of the sheath, and has its lamp housing projecting from such barrel above the first bore of the sheath. That holster has a retainer in its sheath contacting the barrel.

The invention moreover resides in a holster and flashlight combination in which the flashlight has its lamp housing in the first bore of the sheath, and has its barrel projecting from the lamp housing above the holster.

From yet another aspect thereof, the invention resides in a holster for a flashlight having a barrel and having a lamp housing wider than such barrel, comprising a sheath for part of the flashlight having a first bore adapted to receive the lamp housing, and having a narrower second bore adapted to receive the barrel, a first retainer for the lamp housing at the first bore, and a second retainer for the barrel at the second bore.

From still another aspect thereof, the invention resides in a holster for a flashlight having a barrel and having a lamp housing wider than such barrel, and having a tail end protrusion, comprising a sheath for part of the flashlight having a first bore adapted to receive the lamp housing, having a narrower second bore adapted to receive the barrel, and having an axial extension for accommodating the tail end protrusion.

From yet another aspect thereof, the invention resides in a holster for a flashlight having a barrel and having a lamp housing wider than such barrel, comprising a sheath for part of the flashlight having a first bore adapted to receive the lamp housing, and having a narrower second bore adapted to receive the barrel, a belt loop laterally of the sheath, and an adjustable spacer in that belt loop, whereby such belt loop is adaptable to different belt sizes.

BRIEF DESCRIPTION OF THE DRAWINGS

The subject invention and its various aspects and objects will become more readily apparent from the following detailed description of preferred embodiments thereof, illustrated by way of example in the accompanying drawings which also constitute a written description of the invention, wherein like reference numerals designate like or equivalent parts, and in which.

DESCRIPTION OF PREFERRED EMBODIMENTS

Figure 1:
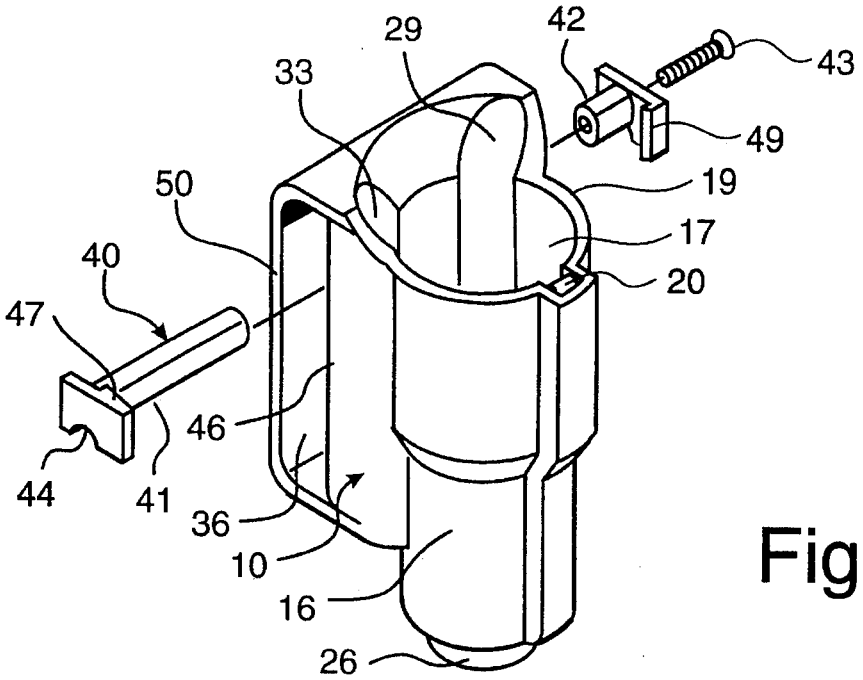
FIG. 1 is a perspective and partially exploded view of a holster according to a preferred embodiment of the invention.

In addition to providing written descriptions of the invention of their own, the accompanying drawings illustrate a holster and flashlight and holster combinations according to preferred embodiments of the invention and methods of handling flashlights relative to such holster.

By way of example, the drawings show holster 10 for or in combination with a flashlight 12 having a barrel 13 and having a lamp housing 14 wider than that barrel. The holster according to the illustrated preferred embodiment of the invention comprises a sheath 16 for part of the flashlight 12. That holster sheath has a first bore 17 adapted to receive the lamp housing 14, such as in FIG. 4, and has a narrower second bore 18 adapted to receive the barrel 13, such as in FIGS. 2 and 3. The illustrated holster has a top opening 19 at its first bore 17.

According to an embodiment of the invention, the holster has a retainer for the flashlight in the sheath 16. In particular, the holster 10 preferably has a first retainer 20 primarily for the lamp housing 14 at the first bore 17, and a second retainer 21 for the barrel 13 at the second bore 18. Such retainers 20 and 21 may, for instance, be leaf springs anchored in elongate channels 22 and 23, respectively, of the holster 10 or sheath 16.

If the flashlight has a tail end switch or other protrusion 25, the sheath 16 preferably has an axial extension 26 for accommodating such tail end protrusion.

The holster 10 or sheath 16 preferably has a top opening 19 and a bottom opening 27 opposite that top opening. Water from rain or condensation, or from an occasional flushing of the sheath 16, may drain through that bottom opening 27.

If the flashlight has any lateral projection, the sheath 16 preferably has an inside channel 29 adapted to accommodate such lateral projection. Such channel may extend in parallel to a longitudinal axis of the holster 10 or elongate sheath 16.

Figure 4:
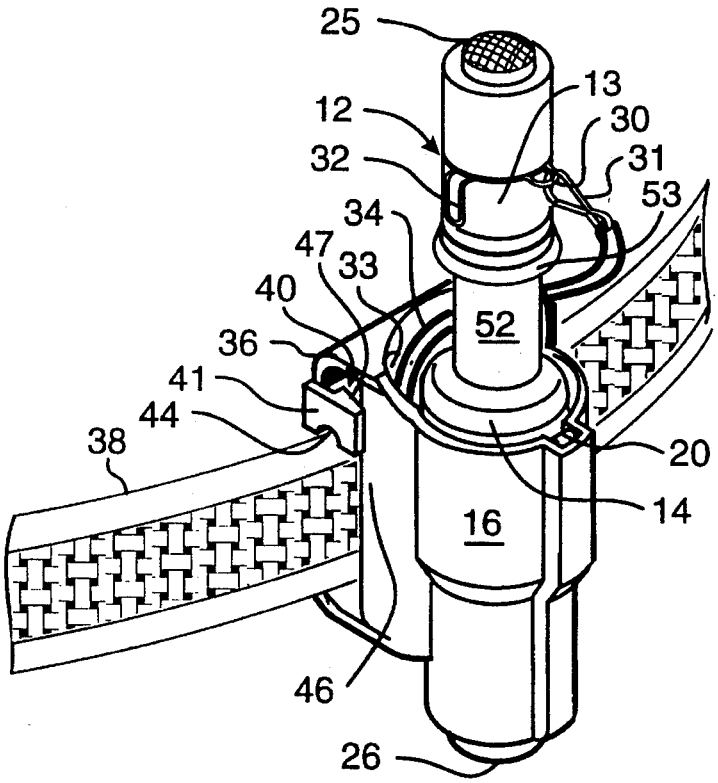
FIG. 4 is a perspective view of a flashlight and holster combination similar to FIG. 3, but with the flashlight invented in the holster.

The term "lateral projection" is used broadly and covers such items as a radially extending loop 30, a spring snap hook or clip 31 and/or a loop 32, such as seen in FIG. 4. If the flashlight has two lateral projections, such as loops 30 and 32 or clip 31 and loop 32, the sheath 16 preferably has a pair of parallel channels 29 and 33 adapted to accommodate such lateral projections.

The loop 30 or clip 31 may serve the releasable attachment of a lanyard 34 to the flashlight 12 or barrel 13. Such lanyard may be encompassed by the term "lateral projection," in that it may be fitted into one of the inside channels, such as into the channel 33, as in the position of the flashlight shown in FIG. 4. The end portion of the lanyard 34 may then be stored in the then empty bore 18 below the lamp housing 14.

According to a preferred embodiment of the invention, the holster includes a belt loop 36 laterally of the sheath 16. Such belt loop permits the holster to be worn on a belt 38 and preferably is adaptable to various belt sizes. In practice, such adjustability is important for precluding undesirable play between the belt 38 and the holster 10, especially when the flashlight 12 is drawn from the holster.

The illustrated embodiment of the invention includes an adjustable spacer 40 in the belt loop 36. Such adjustable spacer preferably comprises a first piece 41 and a second piece 42 releasably attached to that first piece. The second piece 42 may be attached to the first piece 41 by a screw 43 or other releasable fastener. The first and second pieces 41 and 42 jointly straddle the belt loop 36 therebetween on the inside thereof.

The first and second pieces 41 and 42 of the adjustable spacer 40 have belt accommodating notches 44 facing the belt opening in the belt loop 36. In other words, the notches 44 and 45 accommodate a belt, such as the illustrated belt 38 that extends through the main opening of the belt loop 36.

To further preclude undesirable play, the sheath 16 and first and second pieces 41 and 42 preferably have corresponding contact portions 46 and 47, and 48 and 49, respectively, that match only when the belt notches 44 and 45 face a belt or belt opening 38 in the belt loop 36. If the pieces are inserted wrongly so that the belt accommodating notches 44 and 45 would face away from the belt 38, then the projections 47 and 49 would abut the bight portion 50 of the holster belt loop 36, alerting the installer that the belt size adjustment pieces 41 and 42 cannot then be tightened properly by the screw 43, until both pieces are reversed to their proper position shown in FIGS. 1 to 4.

Figure 2:
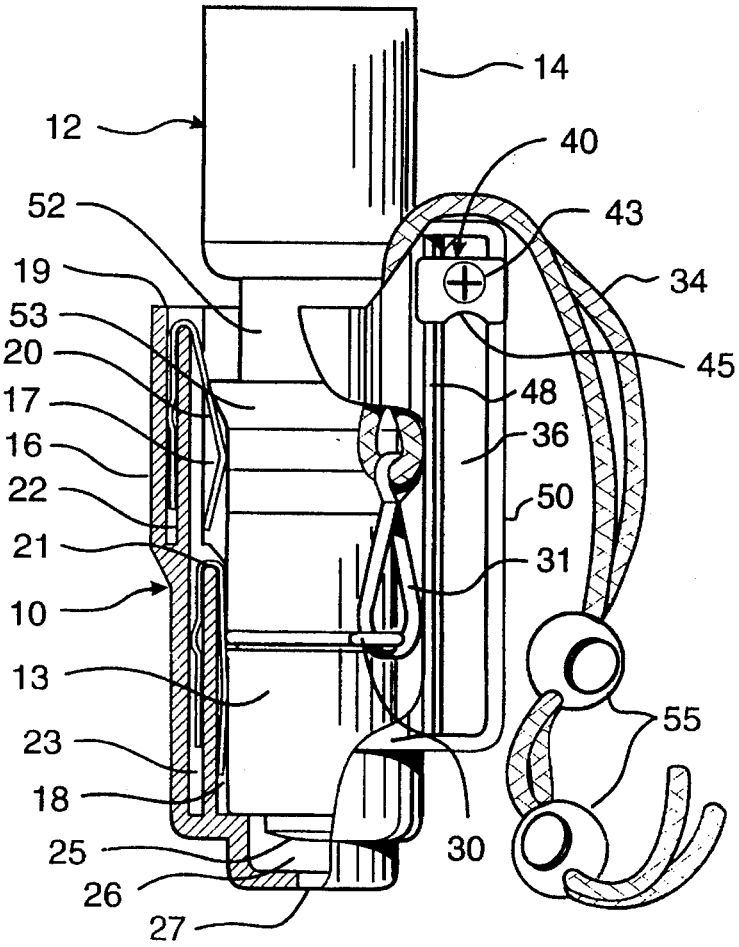
FIG. 2 is a side view of a flashlight and holster combination partially in section, according to an embodiment of the invention, preferably including the holster shown in FIG. 1.
Figure 3:
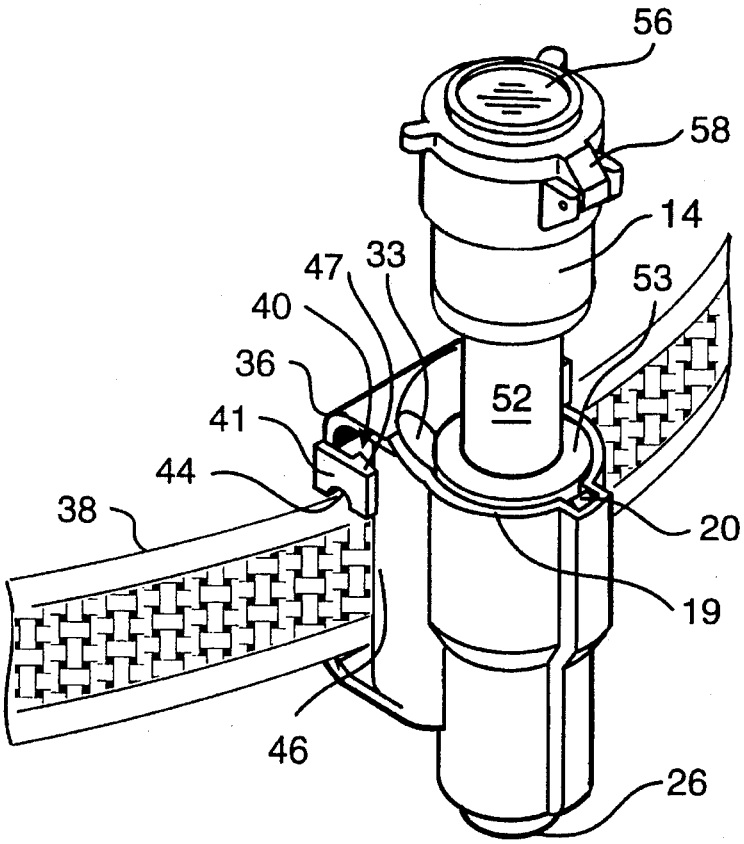
FIG. 3 is a perspective view of a flashlight and holster combination according to an embodiment of the invention similar to FIG. 2.

The invention also resides in a combination of a holster with a flashlight in which the holster comprises a sheath 16 having a first bore 17 adapted to receive the lamp housing 14, and having a narrower second bore 18 adapted to receive the barrel 13, and in which the flashlight 12 has its barrel 13 extending through the first and second bores 17 and 18, and has its lamp housing 14 projecting from such barrel above the first bore, such as in FIGS. 2 and 3. In that case, at least the retainer 21 in the sheath contacts the barrel 13, such as in the bore 18.

The invention also resides in a combination of a holster with a flashlight in which the holster comprises a sheath 16 having a first bore 17 adapted to receive the lamp housing 14, and having a narrower second bore 18 adapted to receive the barrel 13, and in which the flashlight 12 has its lamp housing 14 in the first bore 17, and has its barrel 13 projecting from such lamp housing above the holster, such as in FIG. 4. In that case, the retainer 20 in the sheath contacts the lamp housing 14, such as at the bore 17.

All other features herein disclosed can also be applied to such holster and flashlight combinations.

While the utility of holsters according to the invention is not limited to particular applications, holster and flashlight combinations herein disclosed are very suitable to the use of hand-held flashlights with firearms. One technique of such use has become known as "the Harries technique" and involves holding a handgun with one hand (the "gun hand"), while holding a flashlight with the other hand (the "flashlight hand"), and crossing the "flashlight hand" under the wrist of the "gun hand" for illumination of the target and stabilization of the "gun hand."

Another emerging technique is called "the Rogers technique" after firearm trainer Bill Rogers. That Rogers technique holds the flashlight between the index and middle fingers of the "flashlight hand," such as at a narrow portion 52 of the barrel 13, and activates the flashlight through an electric tail-end switch 25 which is pressed against the ball of the thumb for illumination of the target, while that "flashlight hand" also steadies the "gun hand."

In this respect and in general, the flashlight 12 may be of the kind or type disclosed in U.S. patent application Ser. No. 08/361,755, filed Dec. 22, 1994 by John W. Matthews, Ph.D., for Combat-Oriented Flashlight, assigned to the common assignee hereof, and herewith incorporated by reference herein.

The flashlight 12 preferably has on the battery barrel 13 a reduced diameter portion 52 spaced from the tail-end switch 25 and has on such reduced diameter portion a retention element 53 projecting from that reduced diameter portion for engagement by at least one of the fingers of the human hand during switching of the flashlight at the thumb area or tail end switch 25.

The flashlight 12 is adaptable to various human hand sizes by rendering the retention element 53 adjustable in position on the reduced diameter portion 52 relative to the tail-end switch 25. By way of example, the retention element 53 may be shifted away from the tail end switch 25 for users with large hands. Conversely, the retention element may be shifted closer to that tail end switch for users with small hands.

Handling of the flashlight 12 may be improved by means of a lanyard 34 that may, for instance, be attached to the barrel 13 between its reduced diameter portion 53 and the tail-end switch 25. The lanyard 34 may include a loop that may be tied around the wrist of the user's hand, such as with the aid of one or two adjustable cord locks 55. By way of example, a suitable cord lock, which has a depressable plunger for adjustment purposes along the lanyard, has been disclosed in U.S. Pat. No. 4,288,891, by Ogden W. Boden, issued Sep. 15, 1981, and herewith incorporated by reference herein. Alternatively, the lanyard or loop 32 may be tied around the neck of an athlete or other user.

The barrel 13 typically houses a battery in the form of a single cell or of an assembly of two or more cells having a common terminal at the tail end switch 25, in addition to the opposite terminal at the lamp housing 14.

The lamp housing 14 may include the usual lamp assembly that may have spaced first and second lamp terminals and is adapted to contact the battery barrel 13 and the adjacent battery terminal, respectively. That lamp assembly my include a lamp reflector in the lamp housing 14. A plastic disc or other transparent lens may protect the flashlight bulb and the reflector in the lamp housing 14.

The flashlight 12 when drawn from the holster 10, can be clenched in a person's fist, with the person's fingers extending around part of the circumference of the barrel 13, such as at 52, and the person's thumb being then in a position to activate the flashlight by depression of the end switch 25.

In this manner, the user can forcefully hold and activate the flashlight. For instance, the user can hold the flashlight with clenched fingers at a side of his or her head and can then activate the flashlight with his or her thumb so that it shines into the dark ahead of his or her head without blinding his or her eyes. A user thus can shine the flashlight forcefully and effectively into an attacker's eyes, stunning him and prompting him to go elsewhere.

Moreover, a person can hold the drawn flashlight backward, such in the web between thumb and index finger or between index and middle finger and can then actuate the flashlight with, say, the middle finger or the thumb at the tail-end switch 25. In this manner, the user can shine the light behind his or her person, so as to discourage people that follow him or her too closely.

With practice, the flashlight carried in the holster 10 and easily drawn therefrom, becomes a very effective tactical adjunct of a weapon, or a useful and protective device of unarmed users.

For a quick draw, especially in the performance of the above mentioned Hatties and Rogers techniques, the flashlight preferably is carried in an upside down or "lamp housing down" position, such as shown in FIG. 4.

The alternative "lamp housing up" position, such as shown in FIGS. 2 and 3, permits the flashlight 12 to be inserted into the holster 10 deeper, such as shown in FIG. 2, thereby reducing the overall height of the flashlight and holster assembly. Also, as shown in FIG. 3, the "lamp housing up" position permits the use of an auxiliary device 56 on the lamp housing 14. Such auxiliary devices may include color filters, holographic lenses and other implements that selectively adapt the color of the flashlight beam to a particular task, or that selectively shape the flashlight beam, such as from focused beam to wide-angle flood beam.

The device 56 may be hinged, such as shown at 58 in FIG. 3, so that it can be selectively swung away from the light beam, such as when no filtering or beam modification are desired.

This extensive disclosure will render apparent or suggest to those skilled in the art various modifications and variations within the spirit and scope of the invention.

I claim:

1. A combination of a holster with a flashlight having a barrel having a lateral projection, and having a lamp housing wider than said barrel, wherein:

said holster comprises a sheath for part of said flashlight having a first bore receiving said lamp housing, having a narrower second bore receiving said barrel, and an internal channel accommodating said lateral projection.

2. A combination as in claim 1, including:

a retainer for said flashlight in said sheath.

3. A combination as in claim 1, wherein:

said flashlight has said lamp housing in said first bore, and has said barrel projecting from said lamp housing above said holster.

4. A combination as in claim 3, including:

a retainer in said sheath at said first bore contacting said lamp housing.

5. A combination as in claim 3, including:

a belt loop laterally of said sheath.

6. A combination as in claim 1, wherein:

said flashlight has said barrel extending through said first and second bores, and has said lamp housing projecting from said barrel above said first bore.

7. A combination of a holster with a flashlight having a barrel and having a lamp housing wider than said barrel, wherein:

said holster comprises a sheath for part of said flashlight having a first bore receiving said lamp housing, and having a narrower second bore receiving said barrel;

a first retainer for said lamp housing at said first bore; and a second retainer for said barrel at said second bore.

8. A combination as in claim 7, wherein:

said flashlight has said barrel extending through said first and second bores, and has said lamp housing projecting from said barrel above said first bore.

9. A combination of a holster with a flashlight having a barrel and having a lamp housing wider than said barrel, and having a tail end protrusion, wherein:

said holster comprises a sheath for part of said flashlight having a first bore receiving said lamp housing, having a narrower second bore receiving said barrel, and having an axial extension accommodating said tail end protrusion.

10. A combination as in claim 9, wherein:

said flashlight has said barrel extending through said first and second bores, and has said lamp housing projecting from said barrel above said first bore.

11. A combination as in claim 10, wherein:

said holster has a top opening, and a bottom opening opposite said top opening.

12. A holster for a flashlight including a barrel having a lateral projection and a tail end protrusion, and having a lamp housing wider than said barrel, comprising:

a sheath for part of said flashlight having a first bore adapted to receive said lamp housing, having a narrower second bore adapted to receive said barrel, having an internal channel adapted to accommodate said lateral projection, and having an axial extension for accommodating said tail end protrusion.

13. A holster for a flashlight including a barrel having two lateral projections, and having a lamp housing wider than said barrel, comprising:

a sheath for part of said flashlight having a first bore adapted to receive said lamp housing, having a narrower second bore adapted to receive said barrel, and having a pair of parallel channels adapted to accommodate said lateral projections.

14. A combination of a holster with a flashlight having a barrel and having a lamp housing wider than said barrel, wherein:

said holster comprises a sheath for part of said flashlight having a first bore receiving said lamp housing, and having a narrower second bore receiving said barrel; and said holster has a belt loop laterally of said sheath and an adjustable spacer in said belt loop, whereby said belt loop is adaptable to different belt sizes.

15. A combination as in claim 14, wherein:

said flashlight has said barrel extending through said first and second bores, and has said lamp housing projecting from said barrel above said first bore.

16. A combination as in claim 14, wherein:

said flashlight has said lamp housing in said first bore, and said barrel projecting from said lamp housing above said holster.

17. A combination as in claim 14, wherein:

said adjustable spacer comprises a first piece and a second piece releasably attached to said first piece and jointly straddling said belt loop therebetween.

18. A holster for a flashlight having a barrel and having a lamp housing wider than said barrel, comprising:

a sheath for part of said flashlight having a first bore adapted to receive said lamp housing, and having a narrower second bore adapted to receive said barrel;

a belt loop laterally of said sheath;

an adjustable spacer in said belt loop comprising a first piece and a second piece releasably attached to said first piece and jointly straddling said belt loop therebetween, whereby said belt loop is adaptable to different belt sizes; and said first and second pieces have belt accommodating notches facing a belt opening in said belt loop.

19. A holster as in claim 18, wherein:

said first and second pieces have belt accommodating notches; and said sheath and first and second pieces have corresponding contact portions matching only when said belt notches face a belt opening in said belt loop.

20. A combination of a holster with a flashlight having a barrel and having a lamp housing wider than said barrel, comprising:

a sheath for part of said flashlight having a first bore adapted to receive said lamp housing, and having a narrower second bore adapted to receive said barrel;

said flashlight having said barrel extending through said first and second bores, and having said lamp housing projecting from said barrel above said first bore; and a retainer in said sheath contacting said barrel.

21. A combination as in claim 20, wherein:

said flashlight has a tail end protrusion; and said sheath has an axial extension accommodating said tail end protrusion.

22. A combination as in claim 20, wherein:

said flashlight has a lateral projection; and said sheath has an internal channel accommodating said lateral projection.

23. A combination as in claim 20, including:

a belt loop laterally of said sheath.

24. A combination of a holster with a flashlight having a barrel and a lamp housing wider than said barrel, wherein:

said holster comprises a sheath having a first bore adapted to receive said lamp housing, and having a narrower second bore adapted to receive said barrel;

said barrel extending through the first and second bores; and said lamp housing projecting from said barrel above said first bore.

25. A combination as in claim 24, including:

a retainer in said sheath contacting said barrel.

26. A combination of a holster with a flashlight having a barrel and a lamp housing wider than said barrel, wherein:

said holster comprises a sheath having a first bore adapted to receive said lamp housing, and having a narrower second bore adapted to receive said barrel; and said flashlight has said lamp housing in the first bore, and has said barrel projecting from said lamp housing above said holster; and said holster includes a retainer in said sheath contacting said lamp housing.

* * * * *